US005803700A

United States Patent [19]

Lee

[11] Patent Number: 5,803,700

[45] Date of Patent: Sep. 8, 1998

[54] DEVICE FOR MOUNTING AND DISMOUNTING A HEAVY WEIGHT

[75] Inventor: Byung-Kwan Lee, Inch'eon-Kwangyeok, Rep. of Korea

[73] Assignee: Samsung Electronics Co., Ltd., Suwon, Rep. of Korea

[21] Appl. No.: 804,829

[22] Filed: Feb. 24, 1997

[30] Foreign Application Priority Data

Feb. 28, 1996 [KR] Rep. of Korea ..... 1996-4977

[51] Int. Cl.[6] ..... B66F 1/00

[52] U.S. Cl. ..... 414/589; 414/609; 414/391

[58] Field of Search ..... 414/589, 391, 414/401, 584, 609; 212/176; 901/1, 6, 7; 254/2 R, 2 B, 2 C; 29/281.5, 281.4

[56] References Cited

U.S. PATENT DOCUMENTS 4,440,265 4/1984 Spagnoli ..... 414/589 X 5,249,905 10/1993 Warner et al. ..... 414/401

*Primary Examiner*—Donald W. Underwood

*Attorney, Agent, or Firm*—Jones & Volentine, L.L.P.

[57] ABSTRACT

A device for mounting and dismounting a heavy weight includes a vertical frame having an opening formed on a side thereof, through which a heavy weight is received into the frame. A laterally extending frame is formed at a lower part of the vertical frame. A stopping member is attached to the lateral frame, opposite to the opening, to prevent the heavy weight from being moved outside the frame. A moving device moves the heavy weight to the frame and a lifter raises and lowers the heavy weight in the frame.

7 Claims, 4 Drawing Sheets

DEVICE FOR MOUNTING AND DISMOUNTING A HEAVY WEIGHT

BACKGROUND OF THE INVENTION

1. Field of the Invention

The present invention relates to a device for mounting and dismounting a heavy weight such as a high vacuum pump, and more particularly, to a device for mounting and dismounting a heavy weight, which allows the heavy weight to be easily raised and lowered to and from a fixed height in a frame, so that the mounting and dismounting operation for the heavy weight can be carried out in a simple manner.

2. Description of the Related Art

Generally, in semiconductor manufacturing processes, a heavy equipment, such as a pump for providing a high vacuum, is directly mounted below the lower end of a process chamber. The weight of the high vacuum pump increases depending upon the size and structure of the process and the chamber. For example, in a typical configuration, a 200 l/min pump may weigh over 150 kg.

FIG. 1 is a schematic perspective view of a device for mounting and dismounting a heavy weight of the prior art. FIG. 2 is a schematic side view illustrating a heavy weight mounted to the device of FIG. 1. An opening 3 is formed on a side of a frame 2, and a process chamber 1 is defined above the frame 2. A heavy piece of equipment or heavy weight 4, such as a high vacuum pump, is mounted under the process chamber 1.

In the prior art, in order to mount the heavy weight 4, a number of workers must directly lift the heavy weight 4 and place it inside the frame 2 through the opening 3. Then, when the heavy weight 4 must be placed at a fixed height, it must be raised and lowered a number of times to be bolted to the upper part of the frame 2.

However, in this mounting process for the heavy weight 4, since the heavy weight 4 must be raised and lowered repeatedly in the frame 2, it takes a long time to mount the heavy weight 4. Also, the workers may be injured, perhaps severely, due to careless handling or accidents, or the equipment may be damaged. In addition, when the heavy weight is dismounted, the heavy weight must be lifted while the bolt is unlocked. Therefore, the dismounting process is not only cumbersome and time consuming, but dangerous.

SUMMARY OF THE INVENTION

Accordingly, the present invention has been made in an effort to solve one or more of the problems occurring in the conventional art, and it is an object of the present invention to provide a device for mounting and dismounting a heavy weight which allows a heavy weight such as a high vacuum pump to be easily mounted and dismounted.

According to one aspect of the present invention, there is provided a device for mounting and dismounting a heavy weight, comprising: a vertical frame having an opening formed on a side thereof, through which a heavy weight is received into the frame; a laterally extending frame formed at a lower part of the vertical frame; a stopping member attached to the lateral frame, opposite to the opening, to prevent the heavy weight from being moved outside the frame; moving means for moving the heavy weight to, and receiving the heavy weight into the frame; and lifting means for raising and lowering the heavy weight received in the frame.

According to another aspect of the present invention, the stopping member includes a buffering piece which absorbs shock applied to the stopping member when moving the heavy weight into the frame.

According to still another aspect of the present invention, the lifting means includes a lifting member having a rod which is raised or lowered by oil or air supplied thereto, and a supporting arm mounted to the rod to support the bottom part of the heavy weight.

According to yet still another aspect of the present invention, the moving means includes a seating plate onto which the heavy weight can be seated, and a plurality of casters which are provided on a lower surface of the seating plate.

By the features of the present invention, a heavy weight can be easily raised and lowered to and from a fixed height in a frame, so that mounting and dismounting operations for the heavy weight can be carried out in a simple manner.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
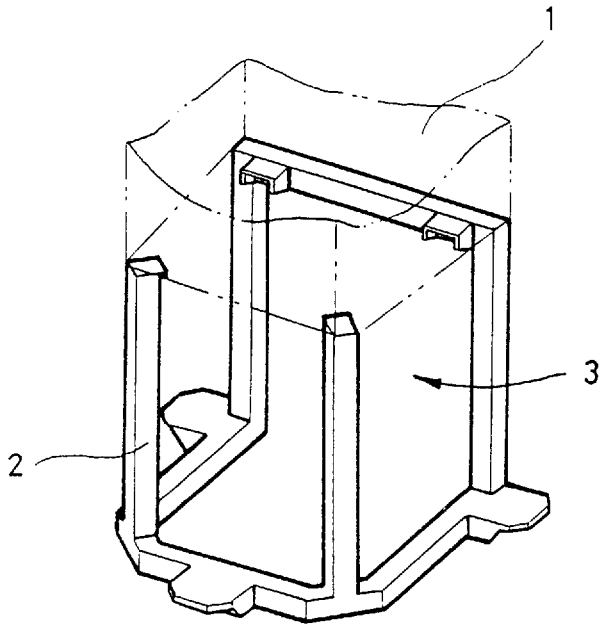
FIG. 1 (Prior Art)
FIG. 1 is a schematic perspective view illustrating a device for mounting and dismounting a heavy weight of the prior art.
Figure 2:
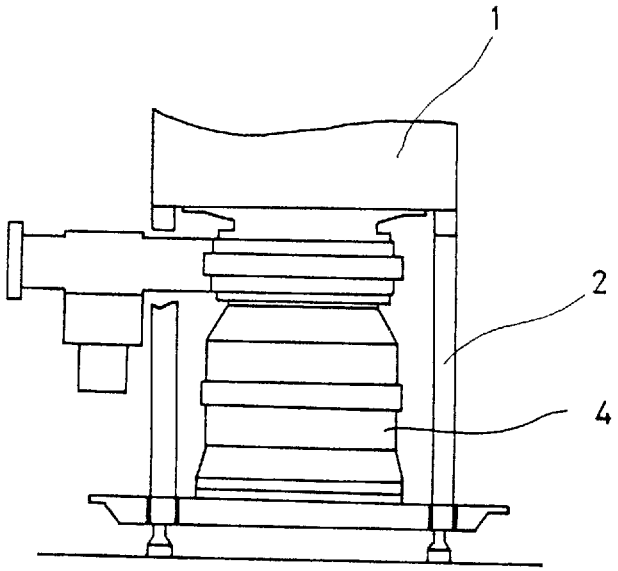
FIG. 2 (Prior Art)
FIG. 2 is a schematic side view illustrating a heavy weight mounted by the device of FIG. 1.
Figure 3:
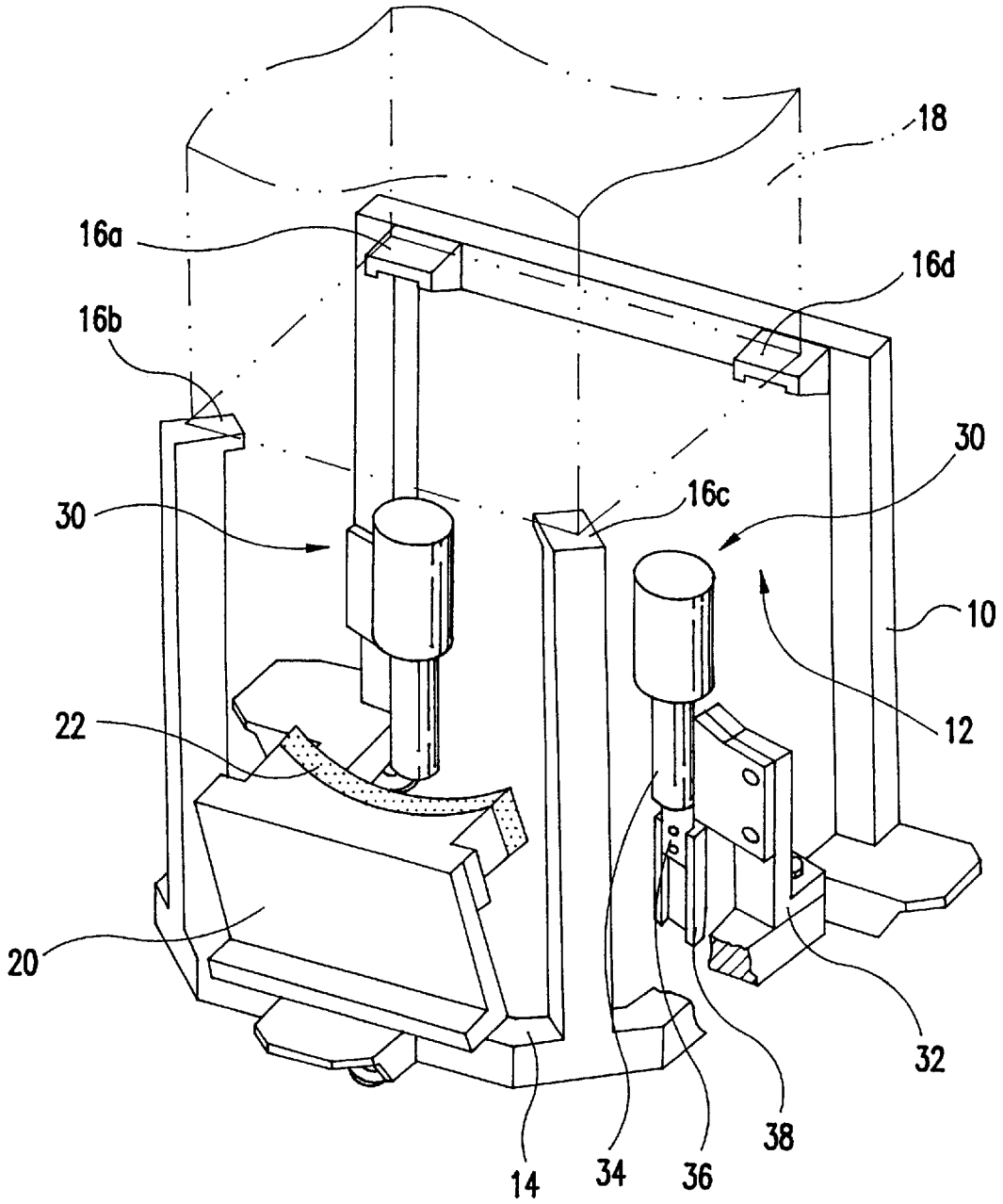
FIG. 3 is a perspective view illustrating a device for mounting and dismounting a heavy weight in accordance with an embodiment of the present invention.

Hereinafter, a device for mounting and dismounting a heavy piece of equipment (hereinafter referred to as a "heavy weight") in accordance with an embodiment of the present invention will now be described in greater detail with reference to the FIGS. 3–5.

The device for mounting and dismounting a heavy weight of the present invention includes a vertical frame 10. An opening 12 is formed on one side of the frame 10 to allow the heavy weight 4 to pass therethrough. A laterally extending frame 14 is formed in the lower part of the frame 10. Also, a plurality of mounting brackets 16*a*, 16*b*, 16*c*, and 16*d* for mounting the heavy weight 4 are formed in the upper part of the frame 10 and project inwardly toward the center of the frame 10. A process chamber 18 is defined above the upper part of the frame 10. When the process to be implemented in the process chamber 18 requires a vacuum generated by a high vacuum pump, the heavy weight 4 high vacuum pump must be mounted in the frame 10.

A stopping member 20 is provided in the lateral frame 14, which is formed on the opposite side of the opening 12, to prevent the heavy weight 4 from being pushed outside beyond the frame 10 when the heavy weight 4 is inserted through the opening 12. A buffering piece 22, which has a curvature corresponding to that of the outer surface of the heavy weight 4, is attached to the inner surface of the stopping member 20. It is preferable that the buffering piece 22 be made of a synthetic resin to dampen the shock applied to the stopping member 20 when the heavy weight 4 is inserted through the opening 12.

A pair of lifters 30 are disposed on both sides of the frame 10 to raise and lower the heavy weight 4 received in the frame 10 through the opening 12. Each respective lifter 30 includes a vertically extending fixed block 32 attached to the lateral frame 14, and a lifting member 34 mounted to a side of the fixed block 32. The lifting member 34 has a rod 36, which is raised or lowered by supplying air or oil pressure thereto, and a supporting arm 38, which is mounted to the lower part of the rod 36 to support the heavy weight 4 (see FIG. 5).

Figure 5:
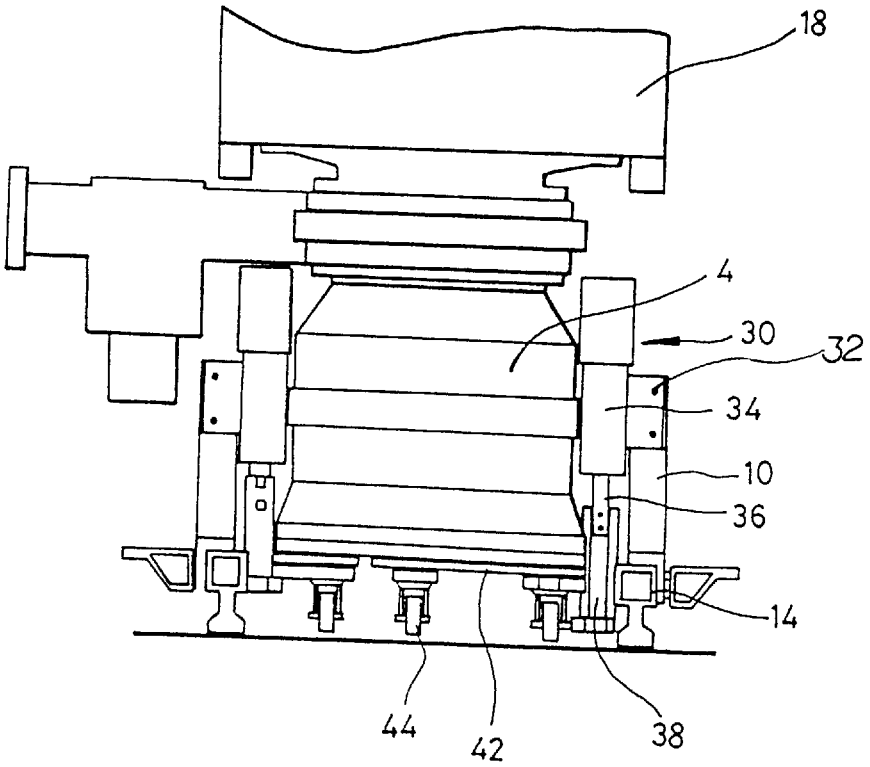
FIG. 5 is a side sectional view illustrating the operation of the device according to the present invention.

The rod 36 and supporting arm 38 are located on the inside of the frame 10 as best seen in FIG. 5. The supporting arm 38 attaches to the lower part of the heavy weight 4 and is lowered by the operation of the rod 36.

Figure 4A:
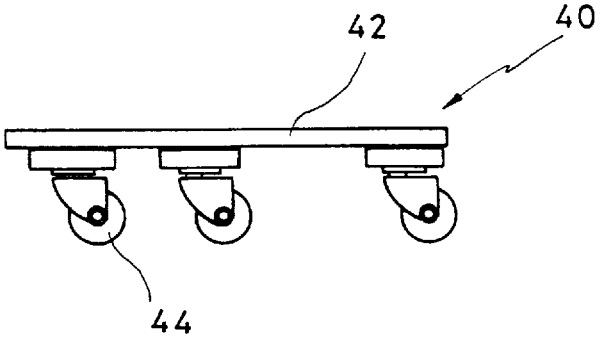
FIG. 4A is a side sectional view of the mover of FIG. 3.
Figure 4B:
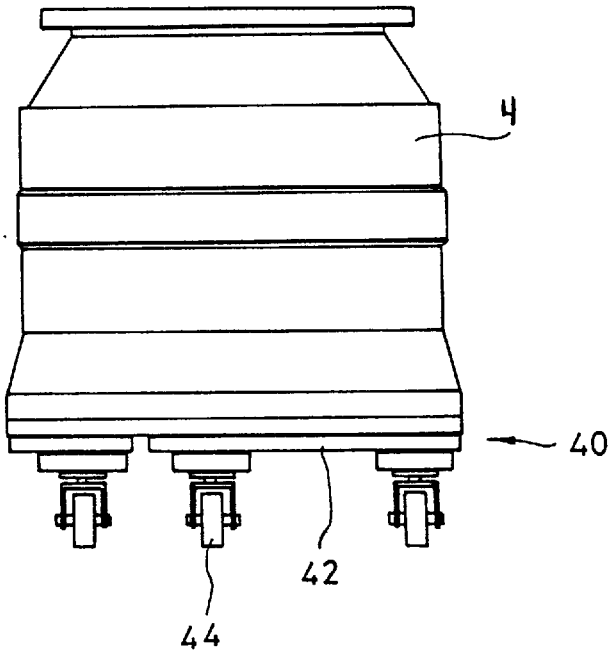
FIG. 4B is a side sectional view illustrating the heavy weight mounted by the device of FIG. 3.

A mover 40 is shown in FIGS. 4A and 4B, and the heavy weight 4 is placed on the mover 40. The mover 40 includes a seating plate 42 onto which the heavy weight 4 is placed, and a plurality of casters 44, which allow the heavy weight 4 placed on the seating plate 42 to be moved.

The operation of the device for mounting and dismounting a heavy weight according to the present invention constructed as mentioned above will now be described.

The heavy weight 4 is placed on the seating plate 42 of the mover 40, and by manipulating the mover 40 having the casters 44, the heavy weight 4 is wheeled into the frame 10 through the opening 12. Since the stopping member 20 is fixed opposite the opening 12, the heavy weight 4 is prevented from being moved outside the frame 10. The rod 36 and the supporting arm 38 of the lifter 30 are maintained in a lowered state.

Next, by manipulating the casters 44 of the lifter 40, a flange portion of the heavy weight 4 is aligned with the mounting brackets 16*a*, 16*b*, 16*c* and 16*d* formed on the upper part of the frame 10, and then the lifter 30 is operated to raise the heavy weight 4. At this time, the rod 36 of the lifter 30 is moved up according to air or oil pressure (not shown) supplied thereto, and, because the supporting arm 38 supports the lower part of the heavy weight 4, the heavy weight 4 is raised together with the supporting arm 38. When the heavy weight 4 is raised to a predetermined height by the operation of the lifter 30, the raising operation of the rod 36 is stopped, and the heavy weight 4 can be mounted to the mounting brackets 16*a*, 16*b*, 16*c* and 16*d* by using bolts, etc. When it is necessary to dismount or remove the heavy weight 4, the above operation is performed in reverse to lower the lifter 30, and thus the heavy weight 4.

As described above, an advantage is provided by using the device for mounting and dismounting a heavy weight of the present invention, since a heavy weight can be raised and lowered to a predetermined height by operating a lifter, and the mounting and dismounting operation for the heavy weight can be performed in a simple manner.

While the present invention has been particularly shown and described with reference to the particular embodiments thereof, it will be understood by those skilled in the art that various changes in form and details may be effected therein without departing from the spirit and scope of the invention as defined by the appended claims and their equivalents.

What is claimed is:

1. A device for mounting and dismounting a heavy weight comprising:

a vertical frame having four fixed vertical posts defining first, second, third and fourth sides and an opening formed on said first side thereof, through which a heavy weight may be received into said vertical frame;

a lateral frame extending along a lower part of said second, third and fourth sides of said vertical frame;

a stopping member attached to the lateral frame along said third side and arranged between adjacent of said fixed vertical posts defining said third side, opposite to said opening, to prevent said heavy weight from being moved outside said vertical frame;

moving means for moving said heavy weight to, and placing said heavy weight into said vertical frame; and a first lifting device and a second lifting device mounted to said lateral frame along said second and fourth sides, respectively, each lifting device being arranged between adjacent of said fixed vertical posts defining said second and fourth sides for raising and lowering said heavy weight received in said vertical frame.

2. A device for mounting and dismounting a heavy weight as claimed in claim 1, wherein said stopping member includes a buffering piece which absorbs shock applied to said stopping member when moving said heavy weight into said vertical frame.

3. A device for mounting and dismounting a heavy weight as claimed in claim 2, wherein said buffering piece has a curvature corresponding to that of an outer surface of the heavy weight.

4. A device for mounting and dismounting a heavy weight as claimed in claim 3, wherein said buffering piece is made of a synthetic resin.

5. A device for mounting and dismounting a heavy weight as claimed in claim 1, each of said first lifting device and second lifting device comprising a lifting member having a rod which is raised or lowered according to oil or air supplied thereto, and a supporting arm mounted to said rod to support a bottom part of said heavy weight.

6. A device for mounting and dismounting a heavy weight as claimed in claim 5, wherein said lifting member is attached to a vertically extending fixed block, which is attached to the lateral frame.

7. A device for mounting and dismounting a heavy weight as claimed in claim 1, wherein said moving means includes a seating plate onto which said heavy weight can be seated, and a plurality of casters which are provided on a lower surface of said seating plate.

* * * * *